US009938987B2

(12) United States Patent
Huang

(10) Patent No.: US 9,938,987 B2
(45) Date of Patent: Apr. 10, 2018

(54) FAN MODULE

(71) Applicants: Inventec (Pudong) Technology Corporation, Shanghai (CN); INVENTEC CORPORATION, Taipei (TW)

(72) Inventor: Wen-Long Huang, Shanghai (CN)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 403 days.

(21) Appl. No.: 14/726,097

(22) Filed: May 29, 2015

(65) Prior Publication Data

US 2016/0305451 A1 Oct. 20, 2016

(30) Foreign Application Priority Data

Apr. 20, 2015 (CN) ..... 2015 1 0188903

(51) Int. Cl.
*F04D 25/16* (2006.01)
*F04D 29/60* (2006.01)
*F04D 25/06* (2006.01)

(52) U.S. Cl.
CPC ..... *F04D 29/601* (2013.01); *F04D 25/0613* (2013.01)

(58) Field of Classification Search
CPC .. F04D 19/002; F04D 19/007; F04D 25/0613; F04D 25/12; F04D 29/60; F04D 29/601; F04D 29/602; F04D 29/603; H05K 7/20172
See application file for complete search history.

(56) References Cited

U.S. PATENT DOCUMENTS 6,592,327 B2 * 7/2003 Chen ..... F04D 25/166 415/213.1
7,537,480 B2 * 5/2009 Li ..... G06F 1/20 439/485
7,699,582 B2 * 4/2010 Tao ..... G06F 1/20 415/213.1
8,740,560 B2 * 6/2014 Gong ..... G06F 1/20 361/695
8,773,853 B2 * 7/2014 Tsai ..... H05K 7/20172 361/695
2008/0286100 A1 * 11/2008 Hu ..... F04D 19/007 415/214.1

* cited by examiner

*Primary Examiner* — Logan Kraft
*Assistant Examiner* — Jason Fountain
(74) *Attorney, Agent, or Firm* — Maschoff Brennan

(57) ABSTRACT

A fan module comprises a frame and at least one filling component. The frame comprises a base plate and a plurality of partition plates. A plurality of air flow channels are formed by the base plate and the plurality of partition plates. Each partition plate has a first fixing slot, a second fixing slot, a third fixing slot and a fourth fixing slot that are located at a side away from the base plate in sequence. The first fixing slot has a first width. The second fixing slot has a second width. The third fixing slot has a third width, and the fourth fixing slot has a fourth width. The filling component is filled in the air flow channels. The first width is the same as the third width. The first width, the second width and the fourth width are different from one another.

14 Claims, 5 Drawing Sheets

FAN MODULE

CROSS-REFERENCE TO RELATED APPLICATIONS

This non-provisional application claims priority under 35 U.S.C. § 119(a) on Patent Application No(s). 201510188903.1 filed in China on Apr. 20, 2015, the entire contents of which are hereby incorporated by reference.

BACKGROUND OF THE INVENTION

Technical Field of the Invention

The disclosure relates to a fan module, more particularly to a fan module capable of being foolproof.

Description of the Related Art

When electronic devices are developed to be smaller in volume and lighter in weight, electronic units in the electronic devices need to be miniaturized. For the electronic units being miniaturized, the electronic units are able to be densely arranged in the electronic devices. However, heat generated by the electronic units cannot be dissipated well, and therefore the temperature of the electronic device increases, which influences the stability and efficiency of operation of the electronic device, and the life span of the electronic device. Therefore, thermal dissipation modules are adopted to dissipate heat generated from the electronic units of the electronic devices.

The thermal dissipation module usually includes fan components, air guiding components and air blocking components. The arrangement of these components is based on the structure of the electronic device. However, if the fan components, the air guiding components and the air blocking components are misplaced, the thermal dissipation efficiency will decrease. Therefore, over heating of the electronic device may occur and then damage electronic units, such as conducting line and circuit board, in the electronic device.

SUMMARY OF THE INVENTION

The disclosure provides a fan module which is foolproof. The fan module prevents misplacing of a fan component, an air guiding component and an air blocking component so that a decrease of thermal dissipation of the fan module caused by misplacing is prevented.

According to one embodiment of the present disclosure, the fan module includes a frame and at least one filling component. The frame includes a base plate and a plurality of partition plates. The plurality of partition plates are arranged at intervals and connected to the base plate. The frame further includes a plurality of air flow channels formed by the base plate and the plurality of partition plates. Each of the plurality of partition plates has a first fixing slot, a second fixing slot, a third fixing slot and a fourth fixing slot that are located at a side away from the base plate in sequence. The first fixing slot has a first width. The second fixing slot has a second width. The third fixing slot has a third width, and the fourth fixing slot has a fourth width. The at least one filling component is filled in the plurality of air flow channels. The at least one filling component has a middle plane. An extending direction of the middle plane intercepts with the plurality of partition plates. A first distance is between the first fixing slot and the middle plane. A second distance is between the second fixing slot and the middle plane. A third distance is between the third fixing slot and the middle plane, and a fourth distance is between the fourth fixing slot and the middle plane. The first width is the same as the third width, the first width, the second width and the fourth width are different from one another, and/or the first distance is the same as the third distance, the distance of the first distance, the second distance and the fourth distance are different from one another.

According to one embodiment of the present disclosure, the frame further has a plurality of air inlets, a plurality of air outlets and a plurality of installing openings. The plurality of air inlets and the plurality of air outlets are formed by the base plate and the plurality of partition plates. The plurality of installing openings are formed by the plurality of partition plates. The plurality of air inlets is located at a plurality of inlet ends of the plurality of air flow channels near the plurality of first fixing slots, respectively. The plurality of air outlets are located at a plurality of outlet ends of the plurality of air flow channels near the plurality of fourth fixing slots, respectively. The plurality of the installing openings are located at a plurality of sides of the plurality of partition plates away from the base plate, respectively.

According to one embodiment of the present disclosure, the at least one filling component is a fan component. The fan component has a first fixing tab. The fan component is detachably installed in one of the plurality of air flow channels by the first fixing tab being detachably fixed to the first fixing slot or the third fixing slot.

According to one embodiment of the present disclosure, the fan component further includes an upper plate and two side plates. The two side plates are connected to two sides of the upper plate that are opposite to each other, respectively. The first fixing tab protrudes outward from one of the two side plates. The fan component further includes an accommodating channel formed by the two side plates and the upper plate. The accommodating channel communicates with the air inlet. A fan is disposed in the accommodating channel.

According to one embodiment of the present disclosure, the at least one filling component is an air guiding component. The air guiding component has a first fixing tab and a second fixing tab. The air guiding component is detachably installed in one of the plurality of air flow channels by the first fixing tab and the second fixing tab being detachably fixed to the first fixing slot and the second fixing slot, respectively.

According to one embodiment of the present disclosure, the at least one filling component is an air guiding component. The air guiding component has a first fixing tab. The air guiding component is detachably installed in one of the plurality of air flow channels with the first fixing tab detachably fixed to the second fixing slot.

According to one embodiment of the present disclosure, the air guiding component further has an upper plate and two side plates. The two side plates are connected to two sides of the upper plate that are opposite to each other, respectively. The first fixing tab and the second fixing tab protrude outward from one of the two side plates. The air guiding component further has an air guiding channel formed by the two side plates and the upper plate. The air guiding channel communicates with the air inlet.

According to one embodiment of the present disclosure, the air guiding component further has an upper plate and two side plates. The two side plates are connected to two sides of the upper plate that are opposite to each other, respectively. The first fixing tab protrudes outward from one of the two side plates. The air guiding component further has an air guiding channel formed by the two side plates and the upper plate. And the air guiding channel communicates with the air inlet.

According to one embodiment of the present disclosure, the at least one filling component is an air blocking component. The air blocking component has a first fixing tab and a second fixing tab. The air blocking component is detachably installed in one of the plurality of air flow channels by the first fixing tab and the second fixing tab being detachably fixed to the third fixing slot and the fourth fixing slot, respectively.

According to one embodiment of the present disclosure, the at least one filling component is an air blocking component. The air blocking component has a first fixing tab. The air blocking component is detachably installed in one of the plurality of air flow channels by the first fixing tab detachably fixed to the fourth fixing slot.

According to one embodiment of the present disclosure, the air blocking component further has an upper plate, two side plates and an air blocking plate. The two side plates are connected to two sides of the upper plate that are opposite to each other, respectively. The first fixing tab and the second fixing tab protrude outward from one of the two side plates. The air blocking plate is connected to the upper plate and located between the two side plates. And the air inlet is covered by the air blocking plate.

According to one embodiment of the present disclosure, the air blocking component further has an upper plate, two side plates and an air blocking plate. The two side plates are connected to two sides of the upper plate that are opposite to each other, respectively. The first fixing tab protrudes outward from one of the two side plates. The air blocking plate is connected to the upper plate and located between the two side plates. And the air inlet is covered by the air blocking plate.

According to one embodiment of the present disclosure, the at least one filling component further has a fixing tab and an elastic fastening tab. Each of the plurality of partition plates further has a fastening hole. When the at least one filling component is installed on the frame, the fixing tab is fixed to the first fixing slot, the second fixing slot, the third fixing slot or the fourth fixing slot, and the elastic fastening tab is fastened to the fastening hole.

According to one embodiment of the present disclosure, the at least one filling component is a fan component. The fan component has an upper plate, a bottom plate, two side plates and a connector. The upper plate is opposite to the bottom plate. The two side plates are between the upper plate and the bottom plate. Two sides of each of the two side plates that are opposite to each other are connected to the upper plate and the bottom plate, respectively. A fan is installed in an accommodating channel formed by the upper plate, the bottom plate and the two side plates. The fan has a connector located on the bottom plate. The base plate further has a connecting hub or an adaptor located on a cable or a circuit board. When the fan component is installed on or removed from the frame, the connector is connected to or removed from the connecting hub or the adaptor.

According to the fan component of the present disclosure, the first width is the same as the third width, the first width, the second width and the fourth width are different from one another. Alternatively, the first distance is the same as the third distance, the distance of the first distance, the second distance and the fourth distance are different from one another. Therefore, the filling component in the frame may not be misplaced such that the function of foolproof is achieved.

BRIEF DESCRIPTION OF THE DRAWINGS

The present disclosure will become more fully understood from the detailed description given hereinbelow and the accompanying drawings which are given by way of illustration only and thus are not limitative of the present invention and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
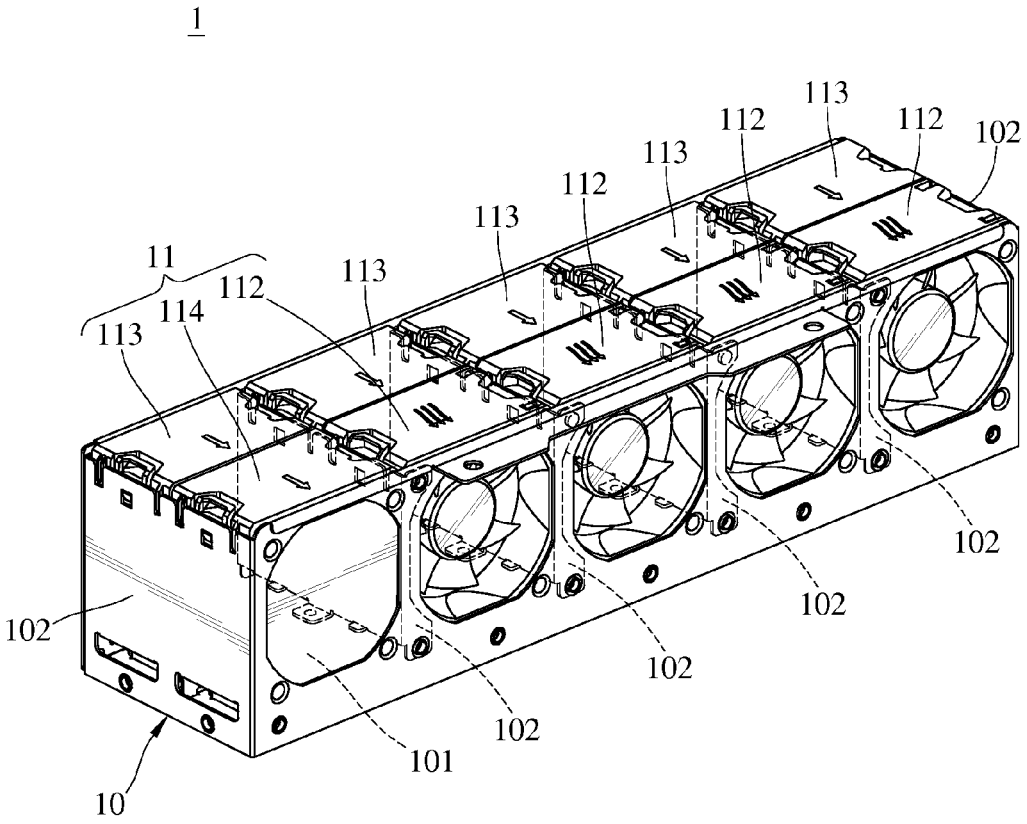
FIG. 1 is a schematic perspective view of a fan module according to a first embodiment of the disclosure.
Figure 2:
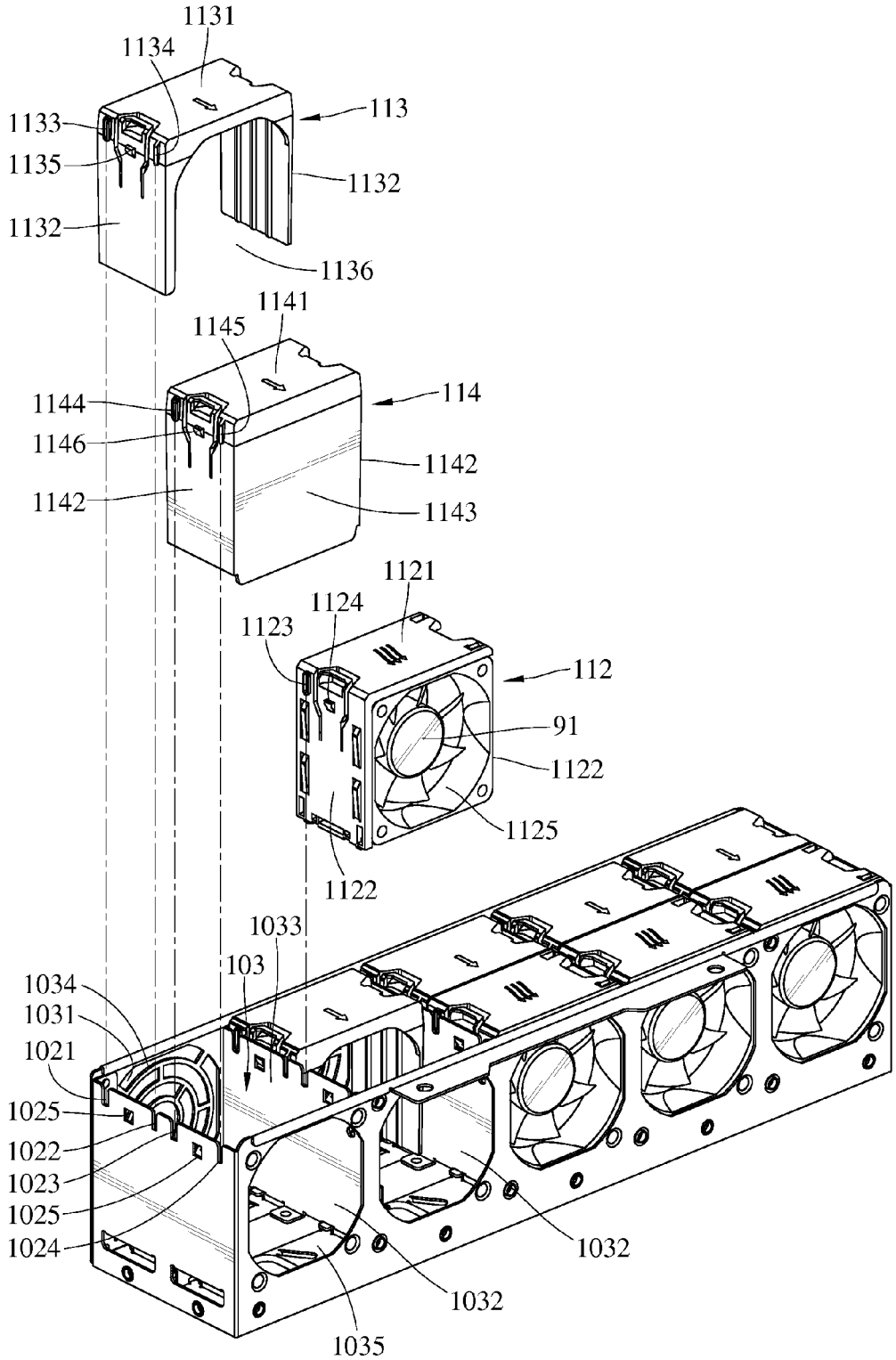
FIG. 2 is an exploded view of the fan module according to the first embodiment of the disclosure.
Figure 3:
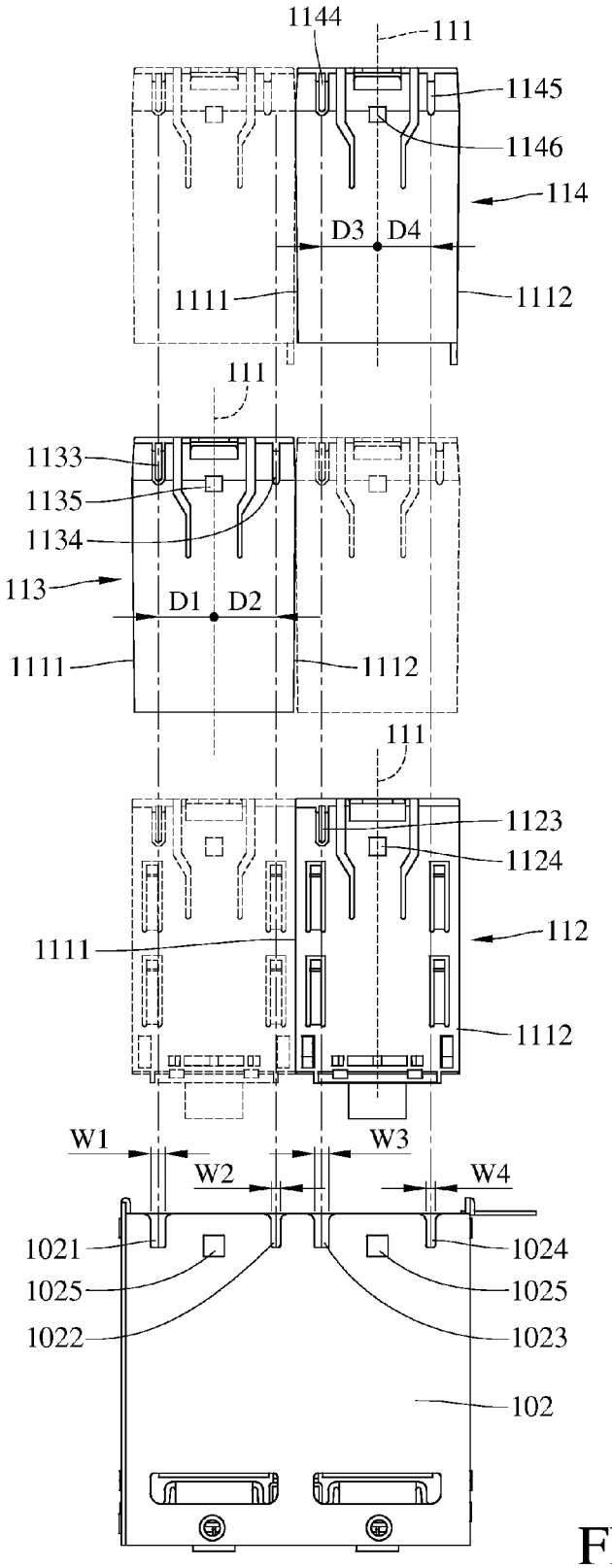
FIG. 3 is a side view of the fan module during assembly according to the first embodiment of the disclosure.

Please refer to FIG. 1 to FIG. 3. FIG. 1 is a schematic perspective view of a fan module according to a first embodiment of the disclosure. FIG. 2 is an exploded view of the fan module according to the first embodiment of the disclosure. FIG. 3 is a side view of the fan module during assembly according to the first embodiment of the disclosure. In this embodiment of the disclosure, the fan module 1 includes a frame 10 and a plurality of filling components 11. In this embodiment, for example, the quantity of the filling components 11 is ten.

The frame 10 includes a base plate 101 and a plurality of partition plates 102. The plurality of partition plates 102 are arranged at intervals therebetween and connected to the base plate 101. Each partition plate 102 has a first fixing slot 1021, a second fixing slot 1022, a third fixing slot 1023 and a fourth fixing slot 1024 that are located at a side away from the base plate 101 in sequence. In addition, each of the partition plates 102 has two fastening holes 1025. The first fixing slot 1021 has a first width W1, the second fixing slot 1022 has a second width W2, the third fixing slot 1023 has a third width W3 and the fourth fixing slot 1024 has a fourth width W4.

In the first embodiment of the present disclosure, each of the first widths W1 is the same as each of the third widths W3. Each of the first widths W1, each of the second widths W2 and each of the fourth widths W4 are different from one another. For example, each of the first widths W1 is 0.5 centimeters (cm), each of the second widths W2 is 0.6 cm, each of the third widths W3 is 0.5 cm, and each of the fourth widths W4 is 0.3 cm. However, these first widths W1, second widths W2, third widths W3, and fourth widths W4 are adjustable to fit the size of these partition plates 102 and actual requirements of users. Therefore, the disclosure is not limited to magnitude of the first widths W1, second widths W2, third widths W3, and fourth widths W4.

Moreover, a plurality of air flow channels 103 a plurality of air inlets 1031 and a plurality of air outlets 1032 are formed by the base plate 101 and the plurality of partition plates 102. A plurality of installing openings 1033 are formed by the plurality of partition plates 102. Each of the plurality of air flow channels 103 has an inlet end 1034 and an outlet end 1035. The inlet end 1034 of the air flow channel 103 and the air inlet 1031 are close to the first fixing slot 1021. The inlet end 1034 and the air inlets 1031 are communicated with each other. The outlet end 1035 of the air flow channel 103 and the air outlet 1032 are close to the fourth fixing slot 1024. The installing opening 1033 is located at a side of the partition plate 102 away from the base plate 101.

As shown in FIG. 3, each of the filling components 11 has a middle plane 111. An extending direction of the middle plane 111 intercepts with the plurality of partition plates 102. Specifically, the middle plane 111 is located between a front end 1111 and a back end 1112 of the filling component 11. The distance between the middle plane 111 and the front end 1111 and the distance between the middle plane 111 and the back end 1112 are the same. Moreover, these filling components 11 are installed in these air flow channels 103, respectively, and detachably connected to the frame 10. When the filling component 11 is installed in the air flow channel 103, a first distance D1 is between the first fixing slot 1021 and the middle plane 111. A second distance D2 is between the second fixing slot 1022 and the middle plane 111. A third distance D3 is between the third fixing slot 1023 and the middle plane 111. A fourth distance D4 is between the fourth fixing slot 1024 and the middle plane 111.

In the first embodiment of the present disclosure, the first distances D1 are the same as the third distances D3. The first distances D1, the second distances D2 and the fourth distances D4 are different from one another. For example, the first distance D1 is 1 cm, the second distance D2 is 1.5 cm, the third distance D3 is 1 cm, and the fourth distance D4 is 1.2 cm. However, the first distance D1, the second distance D2, the third distance D3, and the fourth distance D4 are adjustable to fit the size of the partition plates 102 and actual requirement of user. Therefore, the disclosure is not limited to dimensions of the first distance D1, the second distance D2, the third distance D3, and the fourth distance D4.

Referring to FIGS. 1 through 3, in the first embodiment of the present disclosure, the filling components 11 are four fan components 112, five air guiding components 113 and an air blocking component 114. In detail, each of the fan components 112 includes an upper plate 1121, two side plates 1122, a first fixing tab 1123 and an elastic fastening tab 1124. The two side plates 1122 are connected to two sides of the upper plates 1121 that are opposite to each other, respectively. An accommodating channel 1125 is formed by the two side plates 1122 and the upper plate 1121 to accommodate a fan 91. The first fixing tab 1123 protrudes outward from one of the two side plates 1122 and matches with the first fixing slot 1021 or the third fixing slot 1023 of the partition plate 102. The elastic fastening tab 1124 protrudes outward from one of the two side plates 1122 and matches with a fastening hole 1025 of the partition plate 102.

Each of the air guiding components 113 includes an upper plate 1131, two side plates 1132, a first fixing tab 1133, a second fixing tab 1134 and an elastic fastening tab 1135. The two side plates 1132 are connected to two sides of the upper plates 1131 that are opposite to each other, respectively. An air guiding channel 1136 is formed by the two side plates 1132 and the upper plate 1131. The first fixing tab 1133 and the second fixing tab 1134 protrude outward from one of the two side plates 1132 and match with the first fixing slot 1021 and the second fixing slot 1022 of the partition plate 102, respectively. The elastic fastening tab 1135 protrudes outward from one of the two side plates 1132 and matches with a fastening hole 1025 of the partition plate 102.

Each of the air blocking components 114 includes an upper plate 1141, two side plates 1142, an air blocking plate 1143, a first fixing tab 1144, a second fixing tab 1145 and an elastic fastening tab 1146. The two side plates 1142 are connected to two sides of the upper plates 1141 that are opposite to each other, respectively. The air blocking plate 1143 is connected to the upper plate 1141 and located between the two side plates 1142. The first fixing tab 1144 and the second fixing tab 1145 protrude outward from one of the two side plates 1142 and match with the third fixing slot 1023 and the fourth fixing slot 1024 of the partition plate 102, respectively. The elastic fastening tab 1146 protrudes outward from one of the two side plates 1142 and matches with a fastening hole 1025 of the partition plate 102.

The above descriptions depict about the fan module 1 of the first embodiment of the present disclosure. The following descriptions depict about assembly of the fan module 1.

Please refer to FIG. 3, first, each of the fan components 112 is installed in each of the air flow channels 103 through each of the installing openings 1033, respectively. The first fixing tab 1123 of the fan component 112 is fixed in the first fixing slot 1021 or the third fixing slot 1023 of the partition plate 102 so that the fan component 112 is installed in the frame 10. The fan component 112 has the first fixing tab 1123 without any second fixing tab so that the first fixing tab 1123 can be selectively fixed in the first fixing slot 1021 or the third fixing slot 1023 of the partition plate 102. Please refer to FIGS. 1 and 3, when the first fixing tab 1123 of the fan component 112 is fixed into the third fixing slot 1023 of the partition plates 102, the elastic fastening tab 1124 of the fan component 112 is fixed into fastening hole 1025 of the partition plate 102, and the fan component 112 is located in the air flow channel 103. At this time, the fan 91 is disposed in the accommodating channel 1125 of the fan components 112 which communicates with the air inlet 1031 of the air flow channel 103.

Then, each of the air guiding components 113 is installed in each of the air flow channels 103 through each of the installing openings 1033. The first fixing tab 1133 and the second fixing tab 1134 of the air guiding component 113 are fixed in the first fixing slot 1021 and the second fixing slot 1022 of the partition plate 102, respectively, so that the air guiding components 113 is installed in the frame 10. The first fixing tab 1133 and the second fixing tab 1134 of the air guiding component 113 are matched with the first fixing slot 1021 and the second fixing slot 1022 of the partition plate 102, and the first width W1, the second width W2 and the fourth width W4 of the partition plate 102 are different from one another. Hence, the first fixing tab 1133 and the second fixing tab 1134 of the air guiding component 113 cannot be fixed into the third fixing slot 1023 and the fourth fixing slot 1024 of the partition plate 102 by user so that the foolproof function is achieved. Moreover, the configuration of the air guiding components 113 prevents the airflows going through the air flow channels 103 from interfering with one another. Please refer to FIGS. 1 and 3, when the first fixing tab 1133 and the second fixing tab 1134 of the air guiding component 113 are fixed into the first fixing slot 1021 and the second fixing slot 1022 of the partition plate 102, respectively, the elastic fastening tab 1135 of the air guiding component 113 is fixed into the fastening hole 1025 of the partition plate 102, and the air guiding component 113 is located in the air flow channel 103. At this time, the air guiding channel 1136 of the air guiding component 113 communicates with the air inlet 1031 of the air flow channel 103.

Then, the air blocking components 114 are installed in the air flow channels 103 through the installing openings 1033, respectively. The first fixing tab 1144 and the second fixing tab 1145 of the air blocking component 114 are fixed in the third fixing slot 1023 and the fourth fixing slot 1024 of the partition plate 102, respectively, so that the air blocking component 114 is installed in the frame 10. The first fixing tab 1144 and the second fixing tab 1145 of the air blocking component 114 are matched with the third fixing slot 1023 and the fourth fixing slot 1024 of the partition plate 102, respectively. The first width W1, the second width W2 and the fourth width W4 of the partition plate 102 are different from one another. Thus, the first fixing tab 1144 and the second fixing tab 1145 of the air blocking component 114 cannot be fixed into the first fixing slot 1021 and the second fixing slot 1022 of the partition plate 102 by user so that the function of foolproof is achieved.

Please refer to FIGS. 1 and 3, when the first fixing tab 1144 and the second fixing tab 1145 of the air blocking components 114 are fixed into the third fixing slot 1023 and the fourth fixing slot 1024 of the partition plates 102, respectively, the elastic fastening tab 1146 of the air blocking components 114 are fixed into fastening hole 1025 of the partition plates 102, respectively, and the air blocking components 114 is located in the air flow channels 103, respectively. Furthermore, the air outlets 1032 of the air flow channels 103 are blocked by the air blocking plates 1143 of the air blocking components 114.

Moreover, in the first embodiment of the present disclosure, the first width W1 is the same as the third width W3, and the first width W1, the second width W2 and the fourth width W4 are different from one another. Moreover, the first distance D1 is the same as the third distance D3, and the first distance D1, the second distance D2 and the fourth distance D4 are different from one another. Thus, the function of foolproof is improved, but the disclosure is not limited to the above-mentioned configurations. For example, in other embodiment of the present disclosure, the function of foolproof can be achieved when the first width W1 is the same as the third width W3, and the first width W1, the second width W2 and the fourth width W4 are different from one another, or when the first distance D1 is the same as the third distance D3, and the first distance D1, the second distance D2 and the fourth distance D4 are different from one another.

Figure 4:
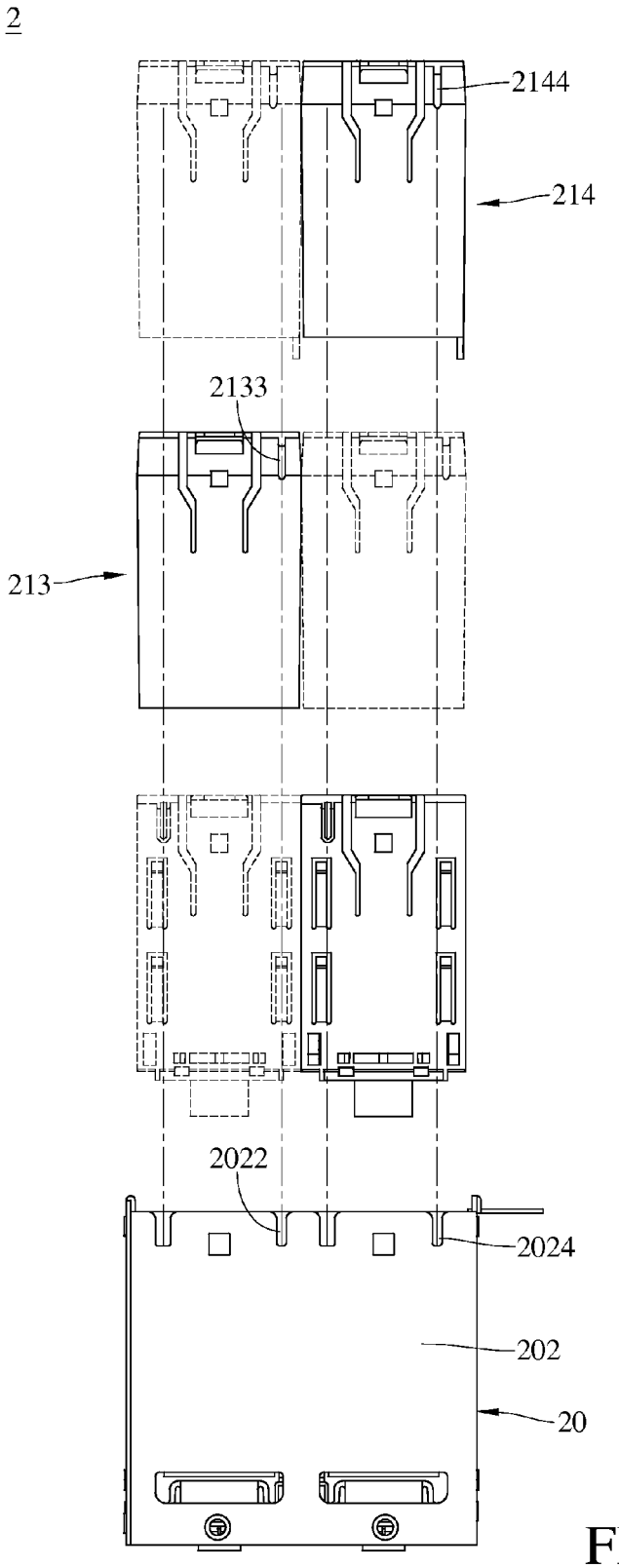
FIG. 4 is a side view of a fan module during assembly according to a second embodiment of the disclosure.

In addition, the disclosure is not limited to the number of the fixing tab of each of the air guiding components 113 and the number of the fixing tab of each of the air blocking components 114. For example, please refer to a second embodiment of the present disclosure in FIG. 4, which is a side view of a fan module during assembly according to the second embodiment of the disclosure. The second embodiment of the present disclosure in FIG. 4 is similar to the first embodiment of the present disclosure in FIG. 1 to FIG. 3. Thus, the explanations of the same structure of the first embodiment and the second embodiment of the present disclosure are not repeated herein.

A difference between the fan module 1 of the first embodiment and the fan module 2 of the second embodiment of the present disclosure is that each of the air guiding components has only one fixing tab 2133 without any second fixing tab, and each of the air blocking component 214 has only one first fixing tab 2144 without any second fixing tab in the second embodiment of the present disclosure. The first fixing tab 2133 of the air guiding component 213 is matched with a second fixing slot 2022 of the partition plate 202, and the first fixing tab 2144 of the air blocking component 214 is matched with a fourth fixing slot 2024 of the partition plate 202. Therefore, the first fixing tab 2133 of the air guiding component 213 cannot be fixed into the fourth fixing slot 2024 of the partition plate 202 by a user, and the first fixing tab 2144 of the air blocking component 214 cannot be fixed into the second fixing slot 2022 of the partition plate 202 by the user when the user tries to install the air guiding components 213 and the air blocking components 214 into the frame 20. Therefore, the function of foolproof is achieved.

In addition, the disclosure is not limited to the numbers of the fan component, the air guiding components and the air blocking components. For example, the filling components in the fan module can be ten fan components.

Figure 5:
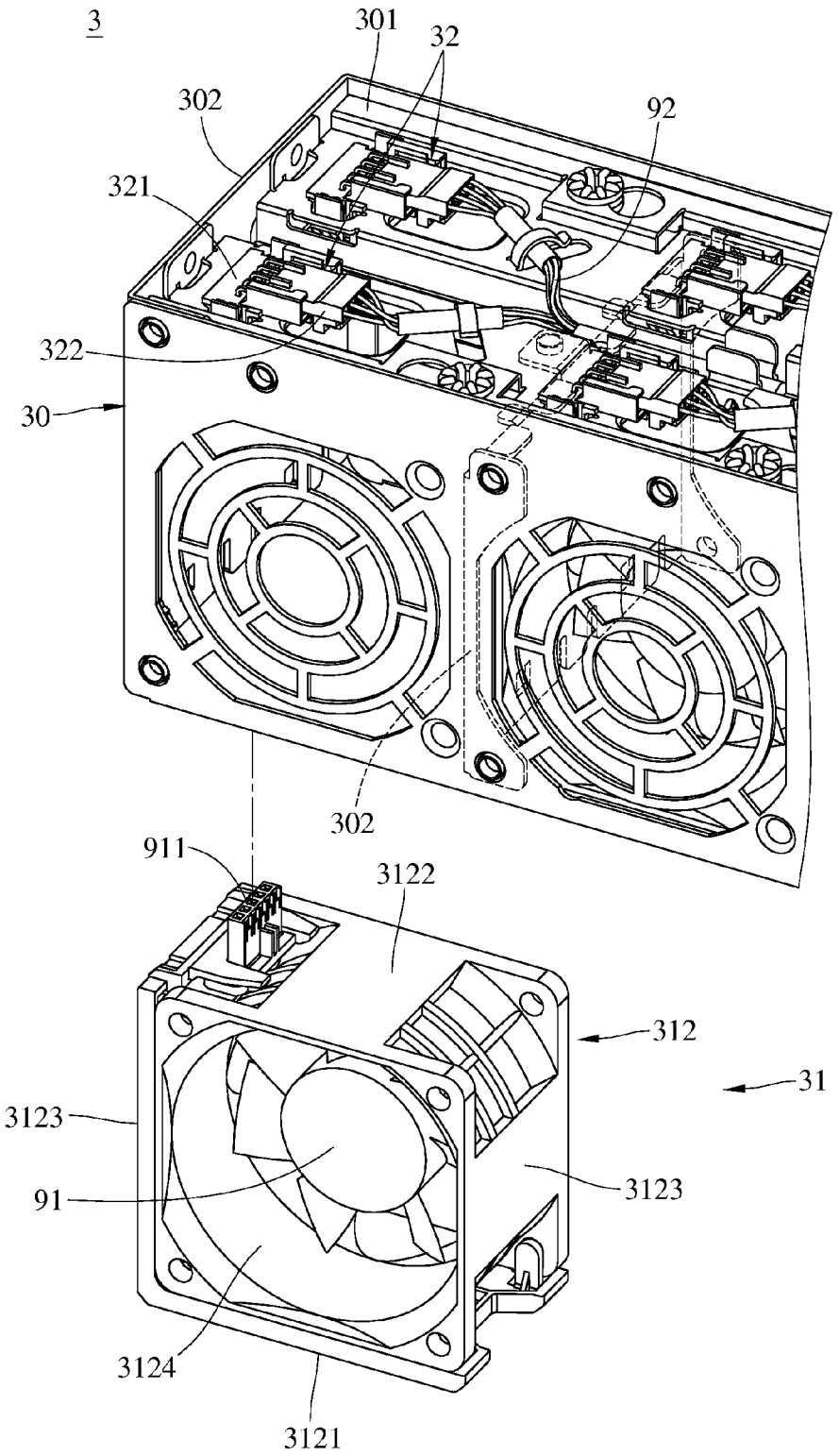
FIG. 5 is a partial schematic perspective view of a fan module according to a third embodiment of the disclosure.

Please refer to a third embodiment of the present disclosure in FIG. 5, which is a partial schematic perspective view of a fan module according to the third embodiment of the disclosure. One difference between the fan module 1 of the first embodiment and the fan module 3 of the third embodiment of the present disclosure is that the filling components in the fan module 3 are ten fan components 312. Each of the fan components has an upper plate 3121, a bottom plate 3122 and two side plates 3123. The upper plate 3121 and the bottom plate 3122 face to each other. The two side plates 3123 are located between the upper plate 3121 and the bottom plate 3122, and two ends of each of the two side plates 3123 that are opposite to each other are connected to the upper plate 3121 and the bottom plate 3122, respectively. An accommodating channel 3124 is formed by the upper plate 3121, the bottom plate 3122 and two side plates 3123 to accommodate a fan 91. The fan 91 has a connector 911 located on the bottom plate 3122 of the fan component 312.

Moreover, another difference between the fan module 1 of the first embodiment and the fan module 3 of the third embodiment of the present disclosure is that the fan module 3 further has ten connecting hubs 32 located on the bottom plates 3122 of the fan components 312, respectively. Each of the connecting hubs 32 includes a first electrical connecting port 321 and a second electrical connecting port 322. When the fan components 312 are installed in the frame 30, the connector 911 of the fan 91 is plugged into the first electrical connecting port 321 of the connecting hub 32, and the second electrical connecting port 322 of the connecting hub 32 can be connected to a cable or a circuit board (not shown).

According to the fan module disclosed in the embodiments of the disclosure, the first width of the first fixing slot and the third width of the third fixing slot are the same, and the first width of the first fixing slot, the second width of the second fixing slot and the fourth width of the fourth fixing slot are different from one another. As a result, when a user is installing the air guiding component and the air blocking component into the frame, the user can fix the first fixing tab and the second fixing tab of the air guiding component with the first fixing slot and the second fixing slot, respectively, and fix the first fixing tab and the second fixing tab of the air blocking component with the third fixing slot and the fourth fixing slot, respectively, so that the function of foolproof is achieved, and the thermal dissipation efficiency of the fan module is improved. Alternatively, the first distances between the first fixing slot and the middle plane and the third distances between the third fixing slot and the middle plane are the same, and the first distances between the first fixing slot and the middle plane, the second distances between the second fixing slot and the middle plane, and the fourth distances between the fourth fixing slot and the middle plane are different from one another so that the air guiding component and the air blocking component may not be misplaced. Therefore, for example, each of the first distances is 1 cm, each of the second distances is 1.5 cm, each of the third distances is 1 cm, and each of the fourth distances is 1.2 cm. However, the first distances, the second distances, the third distances and the fourth distances are adjustable to fit the size of the partition plates and actual requirements of users. Therefore, the function of foolproof is achieved, and the efficiency of thermal dissipation of the fan module is improved.

What is claimed is:

1. A fan module, comprises:

a frame comprising a base plate and a plurality of partition plates, the plurality of partition plates arranged at intervals and connected to the base plate, the frame further including a plurality of air flow channels formed by the base plate and the plurality of partition plates, each of the plurality of partition plates having a first fixing slot, a second fixing slot, a third fixing slot and a fourth fixing slot that are located at a side away from the base plate in sequence, the first fixing slot having a first width, the second fixing slot having a second width, the third fixing slot having a third width and the fourth fixing slot having a fourth width; and two filling components filled in one of the plurality of air flow channels, each of the two filling components having a middle plane, an extending direction of the middle plane intercepting with the plurality of partition plates, a first distance being between the first fixing slot and the middle plane which is located between the first fixing slot and the second fixing slot, a second distance being between the second fixing slot and the middle plane which is located between the first fixing slot and the second fixing slot, a third distance being between the third fixing slot and the middle plane which is located between the third fixing slot and the fourth fixing slot, and a fourth distance being between the fourth fixing slot and the middle plane which is located between the third fixing slot and the fourth fixing slot;

wherein, the first width is the same as the third width, and the first width, the second width and the fourth width are different from one another, and/or the first distance is the same as the third distance, the distance of the first distance, the second distance and the fourth distance are different from one another.

2. The fan module of claim 1, wherein the frame further has a plurality of air inlets, a plurality of air outlets and a plurality of installing openings, the plurality of air inlets and the plurality of air outlets are formed by the base plate and the plurality of partition plates, the plurality of installing openings are formed by the plurality of partition plates, the plurality of air inlets is located at a plurality of inlet ends of the plurality of air flow channels near the plurality of first fixing slots, respectively, the plurality of air outlets are located at a plurality of outlet ends of the plurality of air flow channels near the plurality of fourth fixing slots, respectively, and the plurality of installing openings are located at a plurality of sides of the plurality of partition plates away from the base plate, respectively.

3. The fan module of claim 2, wherein at least one of the two filling components is a fan component, the fan component has a first fixing tab, the fan component is detachably installed in one of the plurality of air flow channels by the first fixing tab being detachably fixed to the first fixing slot or the third fixing slot.

4. The fan module of claim 3, wherein the fan component further comprises an upper plate and two side plates, the two side plates are connected to two sides of the upper plate that are opposite to each other, respectively, the first fixing tab protrudes outward from one of the two side plates, the fan component further includes an accommodating channel formed by the two side plates and the upper plate, the accommodating channel communicates with the air inlet, and a fan is disposed in the accommodating channel.

5. The fan module of claim 2, wherein at least one of the two filling components is an air guiding component, the air guiding component has a first fixing tab and a second fixing tab, the air guiding component is detachably installed in one of the plurality of air flow channels by the first fixing tab and the second fixing tab being detachably fixed to the first fixing slot and the second fixing slot, respectively.

6. The fan module of claim 5, wherein the air guiding component further has an upper plate and two side plates, the two side plates are connected to two sides of the upper plate that are opposite to each other, respectively, the first fixing tab and the second fixing tab protrude outward from one of the two side plates, the air guiding component further has an air guiding channel formed by the two side plates and the upper plate, and the air guiding channel communicates with the air inlet.

7. The fan module of claim 2, wherein at least one of the two filling components is an air guiding component, the air guiding component has a first fixing tab, the air guiding component is detachably installed in one of the plurality of air flow channels with the first fixing tab detachably fixed to the second fixing slot.

8. The fan module of claim 7, wherein the air guiding component further has an upper plate and two side plates, the two side plates are connected to two sides of the upper plate that are opposite to each other, respectively, the first fixing tab protrudes outward from one of the two side plates, the air guiding component further has an air guiding channel formed by the two side plates and the upper plate, and the air guiding channel communicates with the air inlet.

9. The fan module of claim 2, wherein at least one of the two filling components is an air blocking component, the air blocking component has a first fixing tab and a second fixing tab, the air blocking component is detachably installed in one of the plurality of air flow channels by the first fixing tab and the second fixing tab being detachably fixed to the third fixing slot and the fourth fixing slot, respectively.

10. The fan module of claim 9, wherein the air blocking component further has an upper plate, two side plates and an air blocking plate, the two side plates are connected to two sides of the upper plate that are opposite to each other, respectively, the first fixing tab and the second fixing tab protrude outward from one of the two side plates, the air blocking plate is connected to the upper plate and located between the two side plates, and the air inlet is covered by the air blocking plate.

11. The fan module of claim 2, wherein at least one of the two filling components is an air blocking component, the air blocking component has a first fixing tab, the air blocking component is detachably installed in one of the plurality of air flow channels by the first fixing tab detachably fixed to the fourth fixing slot.

12. The fan module of claim 11, wherein the air blocking component further has an upper plate, two side plates and an air blocking plate, the two side plates are connected to two sides of the upper plate that are opposite to each other, respectively, the first fixing tab protrudes outward from one of the two side plates, the air blocking plate is connected to the upper plate and located between the two side plates, and the air inlet is covered by the air blocking plate.

13. The fan module of claim 1, wherein the each of the two filling components further has a fixing tab and an elastic fastening tab, each of the plurality of partition plates further has a fastening hole, when the filling component is installed on the frame, the fixing tab is fixed to the first fixing slot, the second fixing slot, the third fixing slot or the fourth fixing slot, and the elastic fastening tab is fastened to the fastening hole.

14. The fan module of claim 1, wherein at least one of the two filling components is a fan component, the fan component has an upper plate, a bottom plate, two side plates and a connector, the upper plate is opposite to the bottom plate, the two side plates are between the upper plate and the bottom plate, two sides of each of the two side plates that are opposite to each other are connected to the upper plate and the bottom plate, respectively, a fan is installed in an accommodating channel formed by the upper plate, the bottom plate and the two side plates, the fan has a connector located on the bottom plate, the base plate further has a connecting hub or an adaptor located on a cable or a circuit board, when the fan component is installed on or removed from the frame, the connector is connected to or removed from the connecting hub or the adaptor.

* * * * *